US006382323B1

(12) United States Patent
Gano et al.

(10) Patent No.: US 6,382,323 B1
(45) Date of Patent: May 7, 2002

(54) RELEASABLE NO-GO TOOL

(75) Inventors: John C. Gano, Carrollton; David J. Steele, Irving, both of TX (US)

(73) Assignee: Halliburton Energy Services, Inc., Dallas, TX (US)

( * ) Notice: Subject to any disclaimer, the term of this patent is extended or adjusted under 35 U.S.C. 154(b) by 0 days.

(21) Appl. No.: 09/531,861

(22) Filed: Mar. 21, 2000

(51) Int. Cl.[7] ..... E21B 23/01; E21B 23/04
(52) U.S. Cl. ..... 166/382; 166/212; 166/217
(58) Field of Search ..... 166/212, 217, 166/382, 134, 120

(56) References Cited

U.S. PATENT DOCUMENTS

| | | | | | |
|---|---|---|---|---|---|
| 2,681,112 | A | * | 6/1954 | Lee | 166/134 |
| 2,915,011 | A | * | 12/1959 | Hamill | 166/212 |
| 3,318,385 | A | * | 5/1967 | Conrad | 166/212 |
| 3,599,971 | A | * | 8/1971 | Magill | 166/212 |
| 4,595,053 | A | * | 6/1986 | Watkins et al. | 166/209 |
| 4,600,055 | A | * | 7/1986 | Durst et al. | 166/115 |
| 4,669,539 | A | | 6/1987 | Barrington | |
| 4,784,222 | A | * | 11/1988 | Ford | 166/85 |
| 5,002,131 | A | * | 3/1991 | Cromar et al. | 166/382 |
| 5,168,933 | A | * | 12/1992 | Pritchard, Jr. et al. | 166/348 |
| 5,222,555 | A | * | 6/1993 | Bridges | 166/208 |
| 5,437,340 | A | | 8/1995 | Lee et al. | |
| 5,586,601 | A | * | 12/1996 | Pringle | 166/212 |
| 5,931,237 | A | * | 8/1999 | Henke et al. | 175/50 |
| 5,944,102 | A | * | 8/1999 | Kilgore et al. | 166/119 |
| 6,199,632 | B1 | * | 3/2001 | Shy | 166/242.6 |
| 6,209,635 | B1 | | 4/2001 | Gotlib et al. | |

FOREIGN PATENT DOCUMENTS

EP 0 701 045 A2 3/1996

OTHER PUBLICATIONS

United Kingdon Search Report Application No.: GB 0106011.0.

Otis Engineering Corp. Catalog page describing Otis Hydraulic–Activated Running Tool, dated 1990.

Sperry–Sun Drawing 090420, Entitled "7.00 RMLS Latch Assembly Oriented," dated Nov. 16, 1995.

Sperry–Sun Drawing 090471 (two sheets), Entitled "7.00 RMLS Latch Housing Oriented", dated Nov. 16, 1995.

Sperry–Sun Drawing 096148, Entitled "7.00 RMLS Latch Maudrel", dated Nov. 8, 1995.

* cited by examiner

*Primary Examiner*—Hoang Dang
(74) *Attorney, Agent, or Firm*—William M. Imwalle; Marlin R. Smith

(57) ABSTRACT

A releasable no-go tool and associated methods provide enhanced capabilities in positioning an item of equipment in a wellbore. In a described embodiment, a releasable no-go tool includes a circumferentially continuous key which is radially outwardly displaced by a series of pistons. In use, the tool is interconnected in a tubing string, which is lowered into a casing string in a wellbore. The casing string has a nipple interconnected therein, the nipple having an internal profile. The tool is positioned below the nipple, pressure is applied to the tubing string to extend the key, and the tubing string is raised to thereby engage the key with the profile.

22 Claims, 9 Drawing Sheets

RELEASABLE NO-GO TOOL

BACKGROUND OF THE INVENTION

The present invention relates generally to operations performed, and equipment used, in conjunction with a subterranean well and, in an embodiment described herein, more particularly provides a releasable no-go tool and associated methods.

In many circumstances, it is desirable to position an item of equipment in a particular location in a well. For example, a whipstock may be positioned in a casing string to permit a lateral wellbore to be formed by cutting a window in the casing string and drilling the wellbore through the window, a perforating gun may be positioned to perforate the casing string at a particular location, etc.

One method of accurately positioning an item of equipment that has been used in the past is to interconnect an internal no-go shoulder in the casing string when it is installed in the well. In this way, a tubing string subsequently lowered into the casing may include an external no-go shoulder so that, when the internal and external shoulders engage each other, the tubing string is positively positioned relative to the casing string. If the item of equipment is interconnected in the tubing string a known distance from the external no-go shoulder, then upon engagement of the shoulders, the position of the item of equipment in the well is determined.

Unfortunately, the above method is not satisfactory in some situations. For example, where operations are performed from a floating rig, it may be difficult to maintain engagement of the shoulders, due to the tubing string rising and falling with the floating rig. When working from a land-based rig, situations may also arise which make it difficult to maintain engagement of the shoulders while enabling other operations to be performed unhindered. Additionally, it is costly to provide the no-go shoulder in the casing string, and the selection of the no-go shoulder depth in the casing string is limited by structural casing constraints.

From the foregoing, it can be seen that it would be quite desirable to provide a no-go tool and associated methods which permit accurate positioning of items of equipment in a subterranean well.

SUMMARY OF THE INVENTION

In carrying out the principles of the present invention, in accordance with an embodiment thereof, a releasable no-go tool is provided. Methods of releasably securing an item of equipment in a wellbore are also provided.

In one aspect of the present invention, a releasable no-go tool has a housing with an internal axial flow passage. A key is carried on the housing. The key is outwardly biased by a piston when a pressure is applied to the flow passage.

The key may be circumferentially continuous and may circumscribe the housing. This key construction permits increased contact area between the key and an internal profile of a casing string in which the tool is received. The key may also inwardly bias itself when it is outwardly biased by the piston, so that the key may inwardly retract when pressure is relieved from the piston.

In another aspect of the present invention, a method of releasably securing an item of equipment in a wellbore includes the steps of positioning a first tubular string within the wellbore, the first tubular string including a nipple having an internal profile; positioning a second tubular string within the first tubular string, the second tubular string including the item of equipment and a releasable no-go tool having at least one key; applying a first pressure to the second tubular string, thereby extending the key radially outward from the second tubular string; and engaging the key with the profile, thereby securing the item of equipment relative to the first tubular string.

In yet another aspect of the present invention, a downhole equipment positioning system is provided. The system includes a nipple interconnected in a casing string cemented in a well. The nipple has an internal profile. A tubing string is reciprocably received within the casing string. The tubing string includes a tool with at least one key, which is outwardly displaced into engagement with the profile by applying pressure to the tubing string.

These and other features, advantages, benefits and objects of the present invention will become apparent to one of ordinary skill in the art upon careful consideration of the detailed description of representative embodiments of the invention hereinbelow and the accompanying drawings.

DETAILED DESCRIPTION

Figure 1:
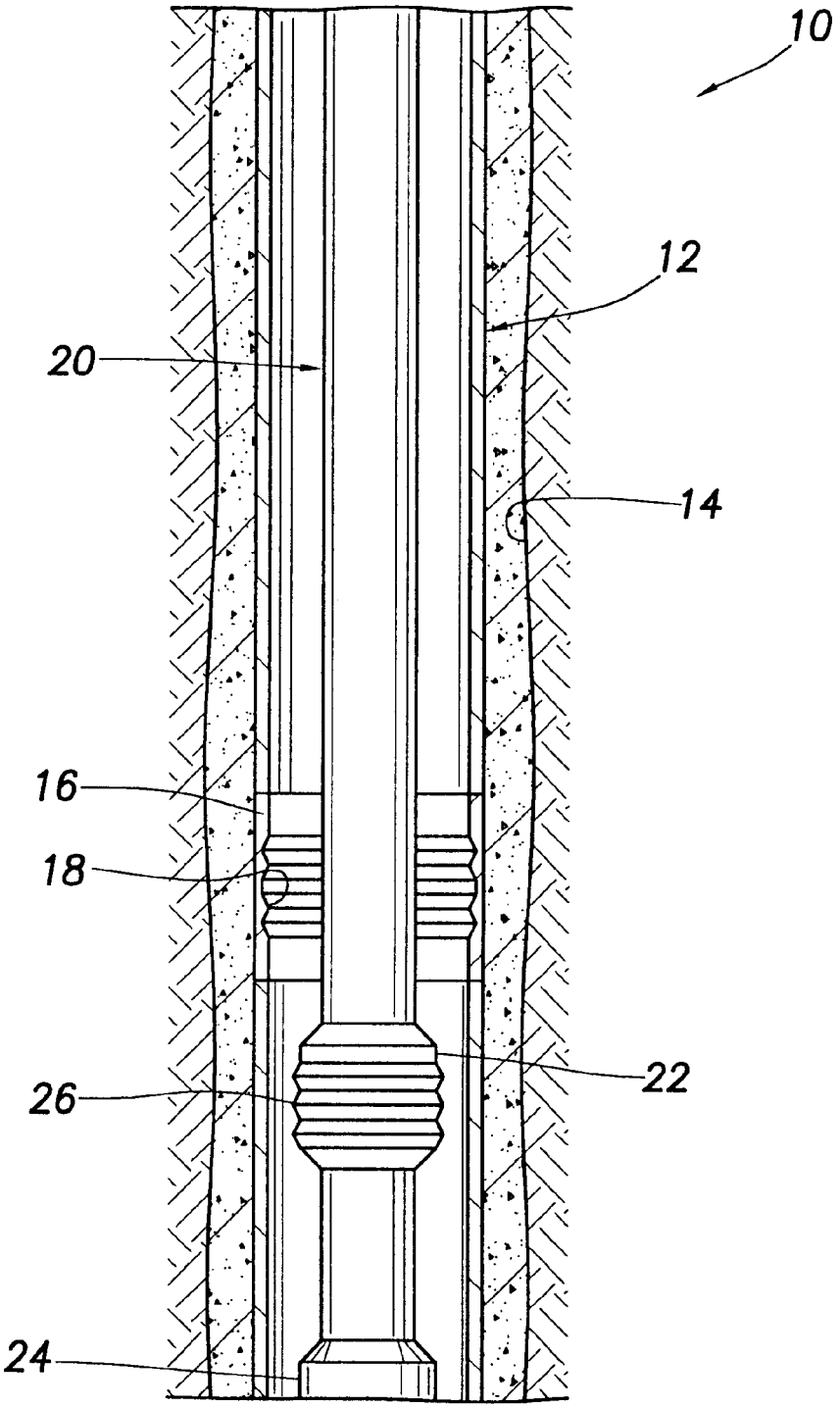
FIG. 1 is a schematic view of a method of positioning an item of equipment in a well, the method embodying principles of the present invention.

Representatively illustrated in FIG. 1 is a method 10 which embodies principles of the present invention. In the following description of the method 10 and other apparatus and methods described herein, directional terms, such as "above", "below", "upper", "lower", etc., are used only for convenience in referring to the accompanying drawings. Additionally, it is to be understood that the various embodiments of the present invention described herein may be utilized in various orientations, such as inclined, inverted, horizontal, vertical, etc., and in various configurations, without departing from the principles of the present invention.

In the method 10, a casing string 12 is installed in a wellbore 14 and cemented therein. As used herein, the term "casing" is used to indicate tubular structures such as casing, liner and similar structures.

The casing string 12 includes a nipple 16 interconnected therein. The nipple 16 has a profile 18 formed internally therein.

Preferably, the nipple 16 is positioned in the casing string 12 a known distance from a particular location in the well. For example, the nipple 16 may be positioned a predetermined distance from a location in the wellbore 14 at which a lateral wellbore (not shown) is to be drilled outwardly through the casing string 12. However, it is to be clearly understood that the method 10 is not restricted to operations wherein a lateral wellbore is to be drilled.

A tubing string 20 is lowered into the well and is reciprocably disposed within the casing string 12. The tubing string 20 includes a releasable no-go tool 22 and an item of equipment 24. The item of equipment 24 may be a whipstock, a perforating gun, a downhole milling device, etc. or any other type of equipment which may be conveyed by the tubing string 20. Additionally, although the item of equipment 24 is depicted in FIG. 1 as being interconnected in the tubing string 20 below the no-go tool 22, such relative positioning is not necessary in keeping with the principles of the present invention.

Preferably, the item of equipment 24 is spaced a known distance from the no-go tool 22 in the tubing string 20. In this manner, the position of the item of equipment 24 in the wellbore 14 will be accurately known once the no-go tool 22 is engaged with the nipple 16, since the position of the nipple in the wellbore is known.

Note that the no-go tool 22 includes at least one key 26. The key 26 is shaped for cooperative engagement with the profile 18. Engagement between the key 26 and the profile 18 provides a means of anchoring the tubing string 20 relative to the casing string 12.

Figure 2:
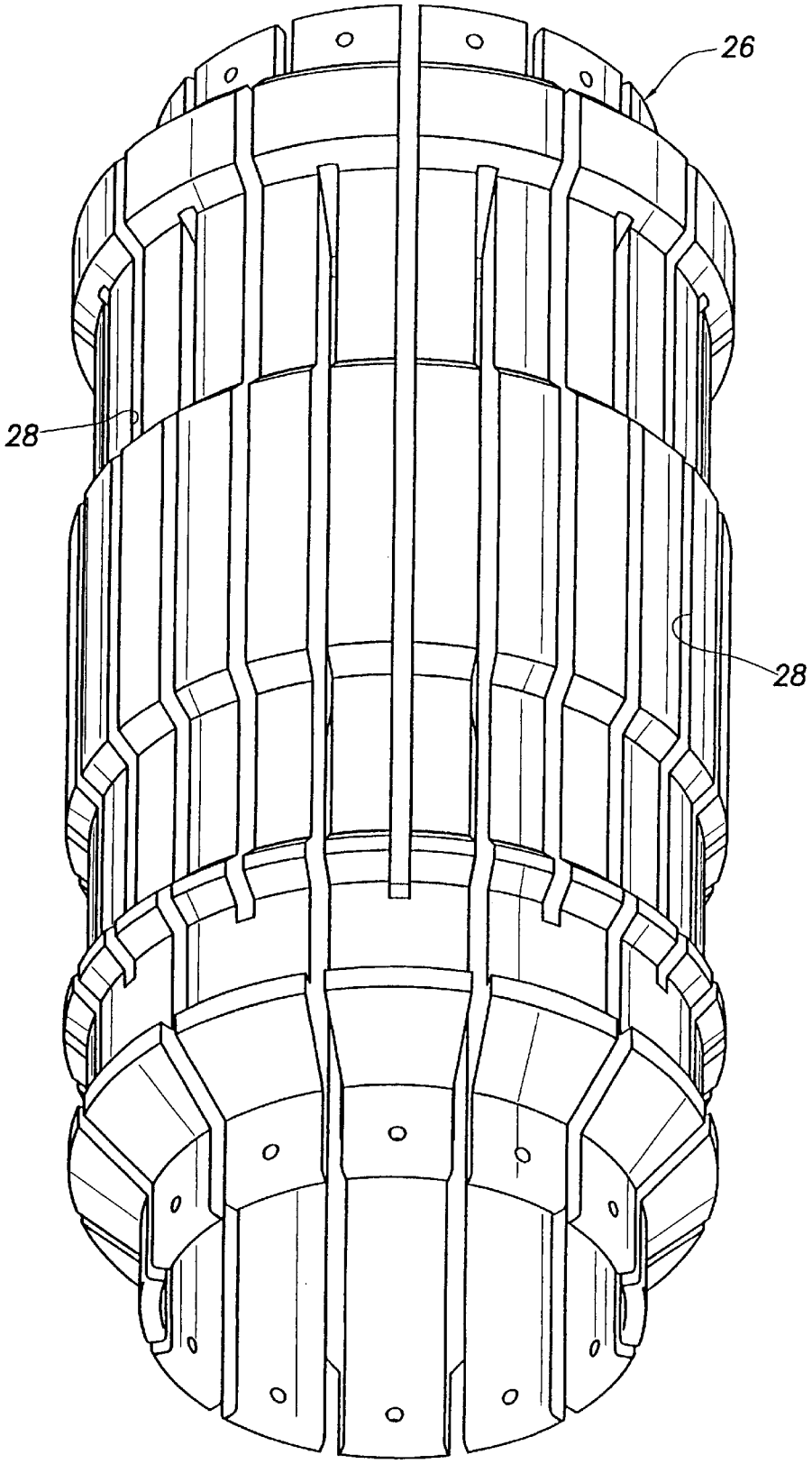
FIG. 2 is an enlarged scale isometric view of a key of a releasable no-go tool used in the method of FIG. 1.

Referring additionally now to FIG. 2, the key 26 is representatively depicted in an enlarged scale isometric view apart from the remainder of the no-go tool 22. In this view, it may be seen that the generally tubular key 26 is circumferentially continuous. Slots 28 are formed in the key 26 alternately from each end of the key. The slots 28 afford some flexibility and resiliency to the key 26 so that, if the key is radially outwardly expanded, it will bias itself radially inward.

Figure 3:
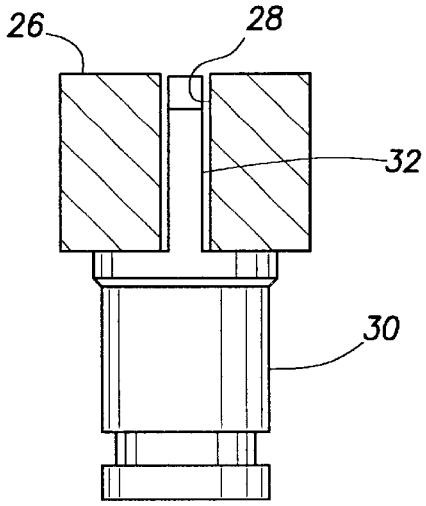
FIG. 3 is an elevational and partially cross-sectional view of a piston and a portion of the key of the releasable no-go tool used in the method of FIG. 1.

Referring additionally now to FIG. 3, a manner in which the key 26 may be radially outwardly expanded is representatively illustrated. A piston 30 has an upwardly extending tab 32 formed thereon. The tab 32 is disposed in one of the slots 28 of the key 26. When the piston 30 is displaced upwardly as viewed in FIG. 3, for example, by pressure applied to the piston, the key 26 will also be upwardly displaced.

Preferably, there are multiple ones of the piston 30 circumferentially distributed within the key 26. Each piston 30 displaces outward when pressure is applied internally thereto. In this manner, the key 26 is outwardly displaced approximately evenly about its circumference when the pistons 30 are displaced outward. When the pressure is removed from the pistons 30, the key 26 biases itself back to its retracted configuration as depicted in FIG. 2.

Note that means other than the pistons 30 may be used to outwardly extend the key 26, without departing from the principles of the present invention. For example, the key 26 could be extended using a mechanical device, such as a wedge, etc., the pistons 30 could be oriented axially, instead of radially, with radial displacement thereof being converted into radial expansion of the key 26 by a cam surface, etc. Thus, it will be readily appreciated that any manner of extending the key 26 may be utilized in keeping with the principles of the present invention.

Referring again to FIG. 1, the tubing string 20 is initially lowered in the well, with the key 26 retracted, until the tool 22 is below the nipple 16. Pressure is then applied to the tubing string 20 to thereby cause the pistons 30 to displace outward and outwardly extend the key 26. The tubing string 20 is then raised, with the key 26 outwardly extended, until the key cooperatively engages the profile 18, thereby anchoring the tubing string relative to the casing string 12 and accurately positioning the item of equipment 24 relative to the wellbore 14.

Tension or compression may be applied to the tubing string 20 to aid in preventing disengagement of the tool 22 from the nipple 16. For example, in the situation where operations are performed from a floating rig (not shown), it may be desirable to apply tension to the tubing string 20. In an embodiment described in detail below, the key 26 and profile 18 may be formed so that such tension (or compression) applied to the tubing string 20 will maintain the key in engagement with the profile 18, even though the pressure outwardly biasing the pistons 30 is released from the tubing string.

To disengage the tool 22 from the nipple 16, the pressure is released from the tubing string 20. Of course, as stated above, the pressure may be released from the tubing string 20 prior to disengaging the tool 22 from the nipple 16. For example, it may be desired to release the pressure from the tubing string 20 to permit certain operations to be performed with the item of equipment 24, etc. As described above, the key 26 may remain engaged with the profile 18 even though the pressure is released from the tubing string 20. In any event, the pressure is released from the tubing string 20 prior to, or at, the time the tool 22 is to be disengaged from the nipple 16.

Once the pressure has been released from the tubing string 20, the key 26 may be disengaged from the profile 18. If the key 26 and profile 18 are configured so that tension or compression in the tubing string 20 maintains the key in engagement with the profile, then the tension or compression is released from the tubing string. The key 26 resiliency biases it back to its retracted configuration. The tubing string 20 is now permitted to displace freely within the casing string 12.

In an embodiment described below, the tool 22 is provided with features that permit it to be disengaged from the nipple 16 in the event that a malfunction prevents the key 26 from being retracted by its own resiliency. For example, a blockage in a fluid passage could prevent the pistons 30 from displacing inwardly when the pressure is released from the tubing string 20, in which case the pressure maintaining the pistons in their outwardly disposed positions should be relieved to permit the pistons to displace inwardly. However, it is to be clearly understood that the tool 22 may be configured differently, and with or without any described additional features, without departing from the principles of the present invention.

Figure 4A:
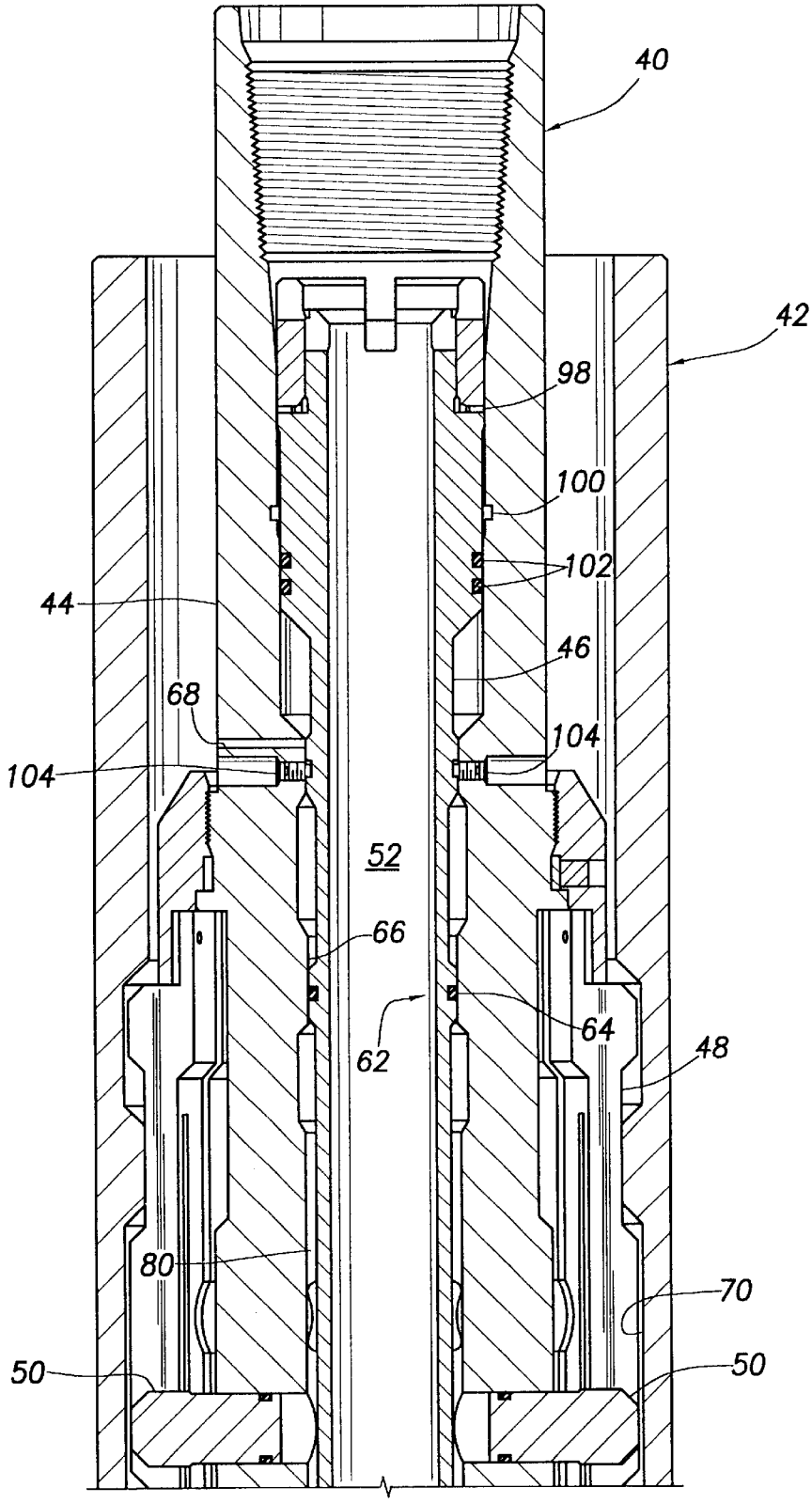
FIGS. 4A&B are cross-sectional views of successive axial portions of a releasable no-go tool embodying principles of the present invention, the tool being shown engaged with a casing nipple.

Referring additionally now to FIGS. 4A&B, a releasable no-go tool 40 embodying principles of the present invention is representatively illustrated positioned within a casing nipple 42. The tool 40 may be utilized for the tool 22 in the method 10, or it may be utilized in other methods. The nipple 42 may correspond to the casing nipple 16 in the method 10. As depicted in FIGS. 4A&B, the tool 40 is engaged with the nipple 42, thereby anchoring the tool relative to the nipple.

The tool 40 includes a generally tubular housing 44, an inner generally tubular mandrel 46, a key 48 and a series of circumferentially spaced apart and outwardly extending pistons 50. The key 48 and the pistons 50 may be similar to the key 26 and pistons 30 described above. An internal flow passage 52 extends generally axially through the housing 44.

Figure 4B:
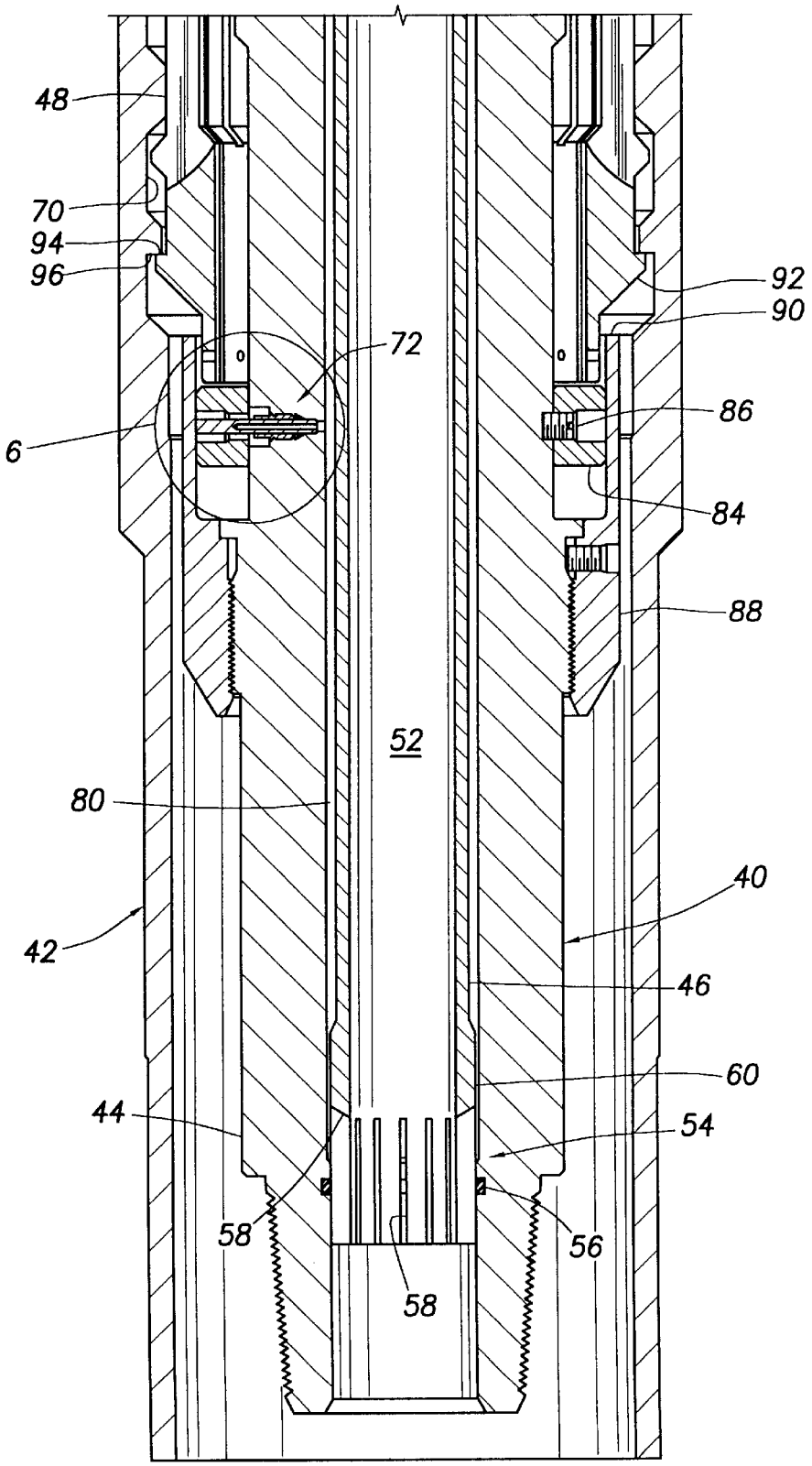

As shown in FIGS. 4A&B, a pressure has been applied to the flow passage 52, thereby outwardly displacing the pistons 50 against an inwardly biasing force exerted by the key 48 due to its own resiliency. Fluid communication between the pistons 50 and the passage 52 is provided by a valve portion 54 of the tool 40. In FIG. 4B, the valve 54 is shown in an open configuration in which pressure may be communicated between the passage 52 and the pistons 50. It will be readily appreciated that, with pressure applied to the passage 52, the pistons 50 are displaced outward, but when this pressure is released from the passage, the resiliency of the key 48 will bias the pistons inward, if the valve 54 is open.

The valve 54 includes a seal 56 carried internally on the housing 44, openings or slots 58 formed through the mandrel 46, and a seal surface 60 formed externally on the mandrel. As depicted in FIG. 4B, fluid flow is permitted through the slots 58. However, if the mandrel 46 is downwardly displaced relative to the housing 44, so that the seal 56 sealingly engages the seal surface 60, fluid flow through the slots 58 and, thus, fluid communication between the pistons 50 and the passage 52 will be prevented.

Another valve portion 62 of the tool 40 controls fluid communication between the pistons 50 and the exterior of the housing 44. Specifically, as shown in FIG. 4A, a seal 64 carried externally on the mandrel 46 sealingly engages a seal surface 66 formed internally on the housing 44. The valve 62, thus, prevents fluid communication between the pistons 50 and the exterior of the housing 44 via a passage 68 formed through the housing. However, if the mandrel 46 is downwardly displaced relative to the housing 44, the seal 64 will disengage from the seal surface 66, and the pistons 50 will be in fluid communication with the exterior of the housing 44.

Therefore, downward displacement of the mandrel 46 relative to the housing 44 closes the valve 54 and simultaneously opens the valve 62. As a consequence, fluid communication between the pistons 50 and the passage 52 is prevented, and fluid communication between the pistons and the exterior of the housing 44 is permitted. This result maybe desirable when it becomes apparent that, even though the pressure has been released from the passage 52 to disengage the key 48 from a profile 70 formed internally in the nipple 42, the key has not in fact been disengaged. Such a situation could occur, for example, if the valve 54 has become plugged with debris, preventing fluid flow therethrough. By closing the valve 54, pressure in the passage 52 is prevented from biasing the pistons 50 outward, and by opening the valve 62 the pistons are vented to the exterior of the housing 44.

To downwardly displace the mandrel 46 relative to the housing 44, pressure is applied to the passage 52. A differential area formed between the seal 64 and seals 102 carried externally on the mandrel 46 biases the mandrel downward in response to the pressure. At a predetermined pressure, shear screws 104 extending through the housing 44 and into the mandrel 46 are sheared, thereby permitting the mandrel to displace downwardly relative to the housing.

A snap ring 98 is carried externally on the mandrel 46. When the mandrel 46 is displaced downwardly relative to the housing 44, the snap ring 98 will eventually extend outward into engagement with an annular groove 100 formed internally in the housing. This engagement between the snap ring 98 and the groove 100 prevents subsequent upward displacement of the mandrel 46 relative to the housing 44. Thus, once the mandrel 46 has been downwardly displaced to open the valve 62 and close the valve 54, the valve 62 remains open and the valve 54 remains closed, without the danger that the mandrel might be inadvertently displaced upward.

Figure 6:
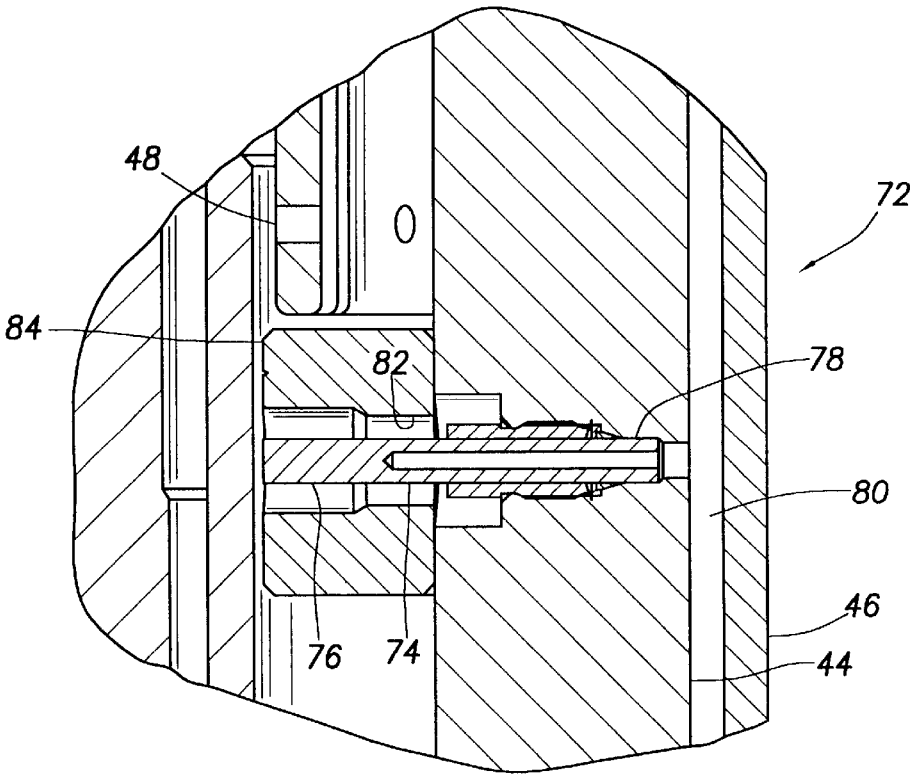
FIG. 6 is an enlarged scale cross-sectional view of a valve portion of the tool of FIGS. 4A&B.

The tool 40 includes another valve portion 72, shown in enlarged scale in FIG. 6. The valve 72 includes a small tube 74 having a closed end 76 and an open end 78. The open end 78 is in fluid communication with an annulus 80 formed radially between the housing 44 and the mandrel 46. The annulus 80 is in fluid communication with the pistons 50.

The tube 74 extends outwardly to the exterior of the housing 44. The closed end 76 extends into an opening 82 formed through a shear ring 84 carried externally on the housing 44 below the key 48. Downward displacement of the ring 84 relative to the housing 44 causes the ring to shear the tube 74, thereby opening the valve 72 and providing fluid communication between the annulus 80 (and, thus, the pistons 50) and the exterior of the housing 44. This provides an additional means of venting the pistons 50 to the exterior of the housing 44, if desired.

The shear ring 84 is releasably secured on the housing 44 by a shear screw 86 extending through the ring and into the housing. The screw 86 is sheared by applying a predetermined force to the housing 44 in an upward direction while the key 48 is engaged with the profile 70. For example, if the housing 44 is interconnected in a tubing string (such as tubing string 20 in the method 10), and difficulty is experienced in disengaging the key 48 from the profile 70, the predetermined force may be applied by picking up on the tubing string to thereby apply the predetermined force to the housing, causing the screw 86 to be sheared and the valve 72 to be opened.

Prior to shearing of the screw 86, the ring 84 abuts a lower end of the key 48, preventing downward displacement of the key relative to the housing 44. When the screw 86 is sheared, the key 48 is permitted to displace downwardly relative to the housing 44.

A key retainer 88 is carried externally on the housing 44. When the screw 86 is sheared and the key 48 displaces downwardly, an upper end 90 of the retainer 88 contacts an inclined surface 92 formed on the key 48. Any further displacement of the key 48 downward relative to the housing 44 will result in the key being forced inward by the contact between the end 90 and the inclined surface 92. Thus, shearing of the screw 86 by applying the predetermined force to the housing 44 not only vents the pistons 50 to the exterior of the housing, but also permits the key 48 to be forcefully retracted out of engagement with the profile 70.

The key 48 has a back angle 94 formed externally thereon, which is complementarily shaped relative to aback angle 96 formed as a part of the profile 70. As used herein, the term "back angle" is used to indicate an included angle of less than ninety degrees between adjacent surfaces formed on a member. The back angles 94, 96 preferably form shoulders on the key 48 and profile 70 inclined approximately 50 to horizontal, but this may be varied if desired, and it is not necessary in keeping with the principles of the present invention for the back angles to be provided on the key and profile.

It will be readily appreciated that engagement of the back angles 94, 96 as shown in FIG. 4B prevents retraction of the key 48 out of engagement with the profile 70, even though there may be no pressure applied to the passage 52, unless the key is permitted to displace downwardly relative to the profile 70 so that the back angles may disengage. Thus, with an upward force applied to the housing 44 to maintain the back angles 94, 96 engaged with each other, the pressure may be released from the passage 52, without the key 48 being disengaged from the profile 70.

However, as mentioned above, it is not necessary for the back angles 94, 96 to be provided at all, since even a positive angle, for example, less than the friction angle for the key 48 and profile 70, is sufficient to maintain engagement therebetween.

Figure 5A:
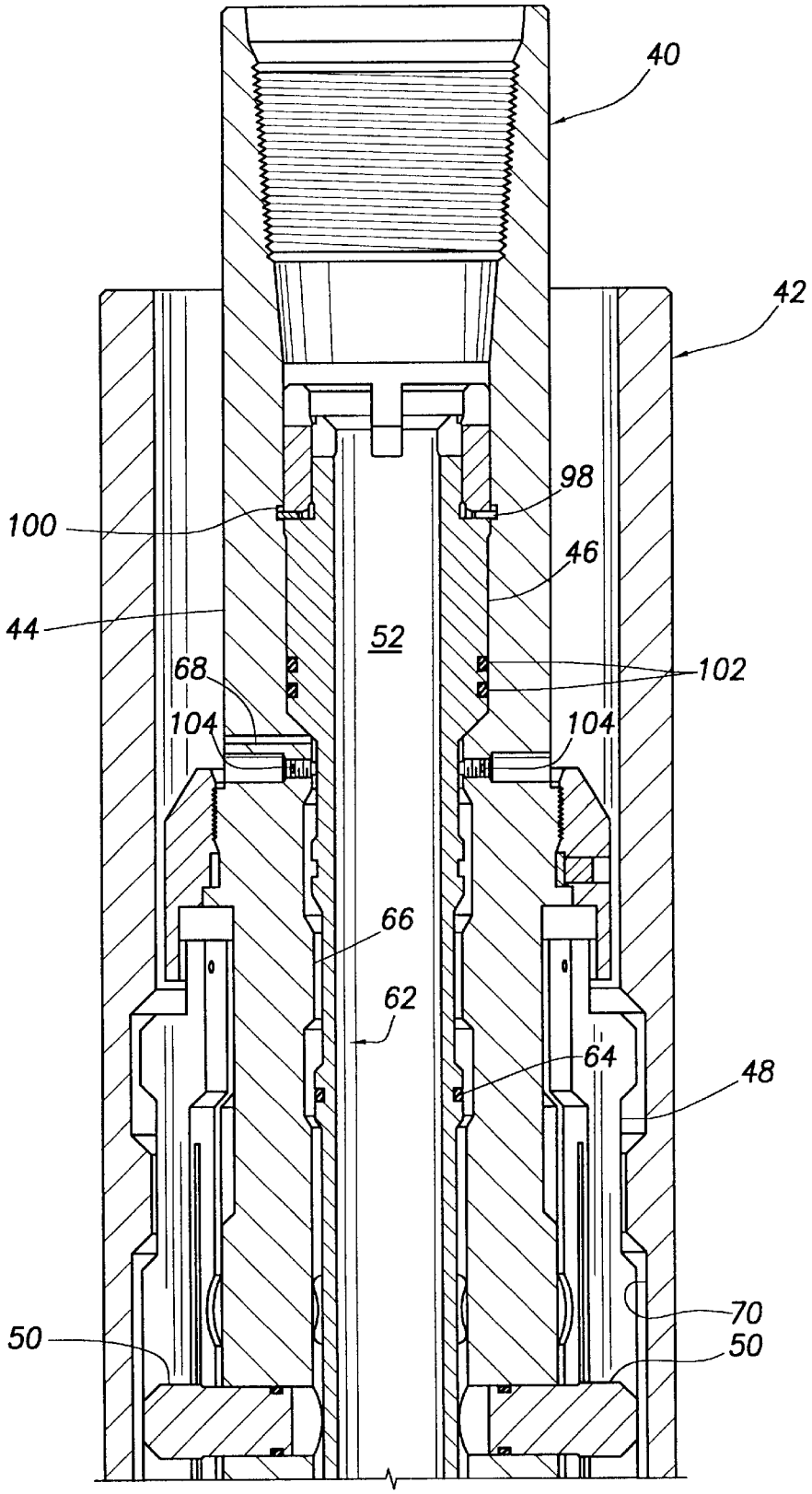
FIGS. 5A&B are cross-sectional views of successive axial portions of the tool of FIGS. 4A&B, wherein a pressure has been applied to the tool, and a force has been applied to the tool, to permit its release from the casing nipple.
Figure 5B:
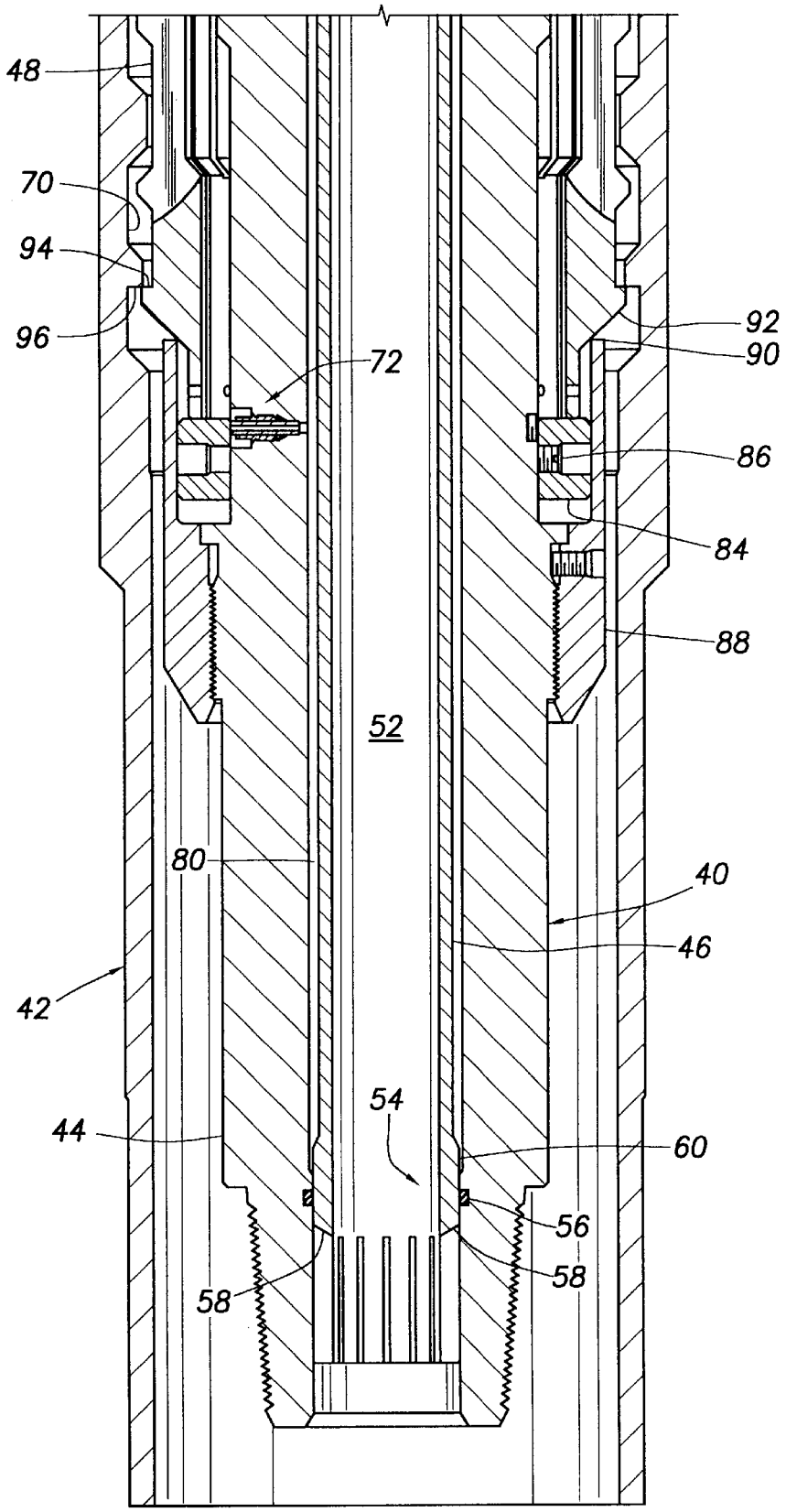

As described above, the tool 40 is depicted in FIGS. 4A&B in a configuration in which pressure has been applied to the passage 52 to thereby outwardly displace the pistons 50 and engage the key 48 with the profile 70. Of course, as also described above, the pressure maybe released from the passage 52 while applying upward tension to the housing 44, to thereby maintain the key 48 in engagement with the profile 70, due to the engagement of the back angles 94, 96. Referring additionally now to FIGS. 5A&B, the tool 40 is depicted in a configuration in which further pressure has been applied to the passage to shear the screws 104 and downwardly displace the mandrel 46 relative to the housing 44.

In FIGS. 5A&B, it may be seen that, due to downward displacement of the mandrel 46, the valve 62 has been opened, the valve 54 has been closed, and the snap ring 98 has engaged the groove 100, thereby preventing upward displacement of the mandrel relative to the housing 44. In addition, a predetermined upwardly directed force has been applied to the housing 44 to shear the screw 86, thereby opening the valve 72 and permitting the key 48 inclined surface 92 to contact the upper end 90 of the key retainer 88. The pistons 50 are now vented to the exterior of the housing 44 via the valves 62, 72 and prevented from fluid communication with the passage 52 by the valve 54. Note that it is not necessary for the mandrel 46 to be downwardly displaced before the upwardly directed force is applied to the housing 44 to shear the screw 86. The upwardly directed force may be applied to the housing 44 prior to, or instead of, downwardly displacing the mandrel 46. Furthermore, the mandrel 46 may be downwardly displaced without applying the upwardly directed force to the housing 44.

Figure 7A:
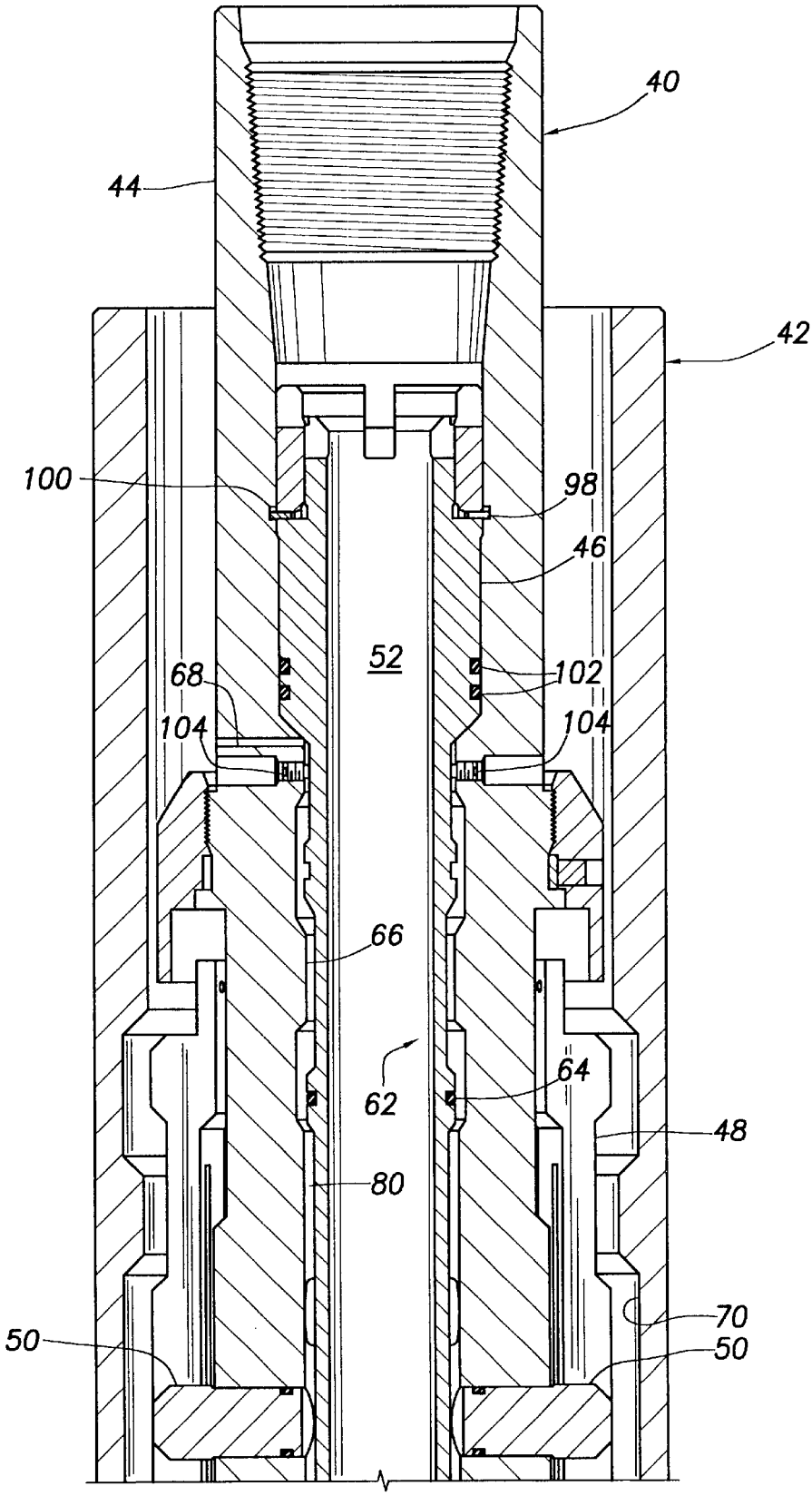
FIGS. 7A&B are cross-sectional views of successive axial portions of the tool of FIGS. 4A&B, wherein the key has been fully retracted out of engagement with the casing nipple.
Figure 7B:
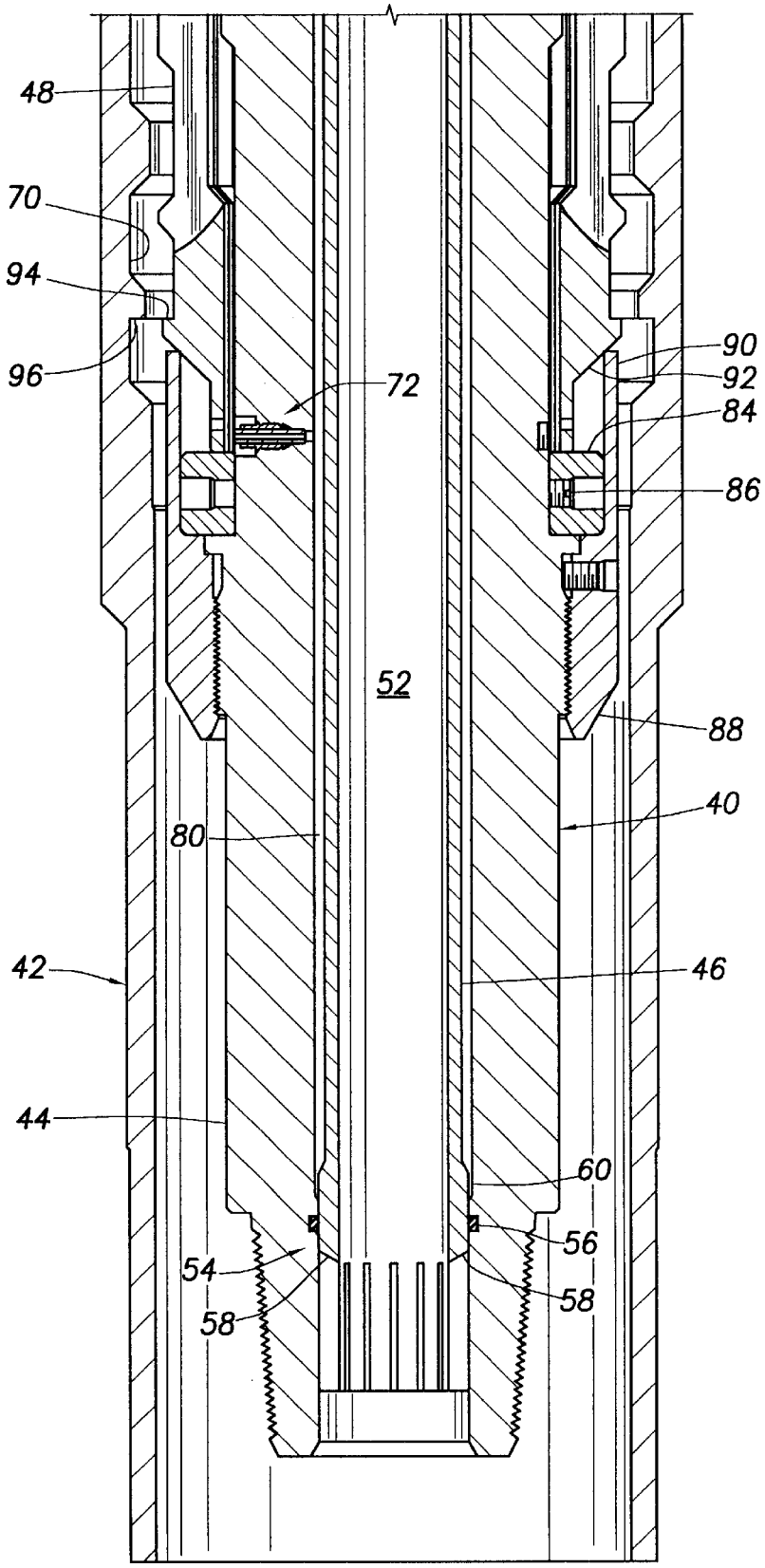

Referring additionally now to FIGS. 7A&B, further upward displacement of the housing 44 relative to the key 48 has caused the upper end 90 of the retainer 88 to force the key inward, thereby disengaging the key from the profile 70. The tool 40 may now be displaced upwardly relative to the nipple 42.

Thus has been described the releasable no-go tool 40 which, when used in a method, such as the method 10 described above, permits accurate positioning of equipment in a wellbore. Of course, a person skilled in the art would, upon a careful consideration of the above description of representative embodiments of the invention, readily appreciate that many modifications, additions, substitutions, deletions, and other changes may be made to these specific embodiments, and such changes are contemplated by the principles of the present invention. For example, instead of the single key 48, multiple keys could be used, the tool 40 could be inverted, the key and profile 70 could be configured so that back angles formed thereon maintain engagement therebetween when an upwardly directed force is applied to the housing 44, a means of radially orienting the tool relative to the nipple 42 could be provided, etc. Accordingly, the foregoing detailed description is to be clearly understood as being given by way of illustration and example only, the spirit and scope of the present invention being limited solely by the appended claims.

What is claimed is:

1. A releasable no-go tool, comprising:

a generally tubular housing having a flow passage extending generally axially therethrough;

at least one inwardly biased key carried on the housing;

at least one piston outwardly biasing the key when fluid pressure is applied to the flow passage;

a first valve in communication with the piston;

a member displaceable relative to the housing to actuate the first valve; and a second valve in communication with the piston.

2. The tool according to claim 1, wherein displacement of the member actuates the second valve.

3. The tool according to claim 1, wherein the first valve selectively permits and prevents fluid communication between the piston and the flow passage and the second valve selectively permits and prevents fluid communication between the piston and the exterior of the housing.

4. The tool according to claim 1, wherein displacement of the member simultaneously closes the first valve and opens the second valve.

5. A releasable no-go tool, comprising:

a generally tubular housing having a flow passage extending generally axially therethrough;

at least one inwardly biased key carried on the housing; and at least one piston outwardly biasing the key when fluid pressure is applied to the flow passage, the key being releasably secured against axial displacement relative to the housing in at least one direction, the key being released for axial displacement relative to the housing in the direction when a predetermined force is applied to the key.

6. The tool according to claim 5, further comprising a valve, the valve being opened to permit fluid communication between the piston and the exterior of the housing when the predetermined force is applied to the key.

7. A releasable no-go tool, comprising:

a generally tubular housing having a flow passage extending generally axially therethrough;

at least one inwardly biased key carried on the housing; and at least one piston outwardly biasing the key when fluid pressure is applied to the flow passage, the key having a back angle formed externally thereon, the back angle being engageable with a complementarily shaped profile formed internally on a tubular structure, when the tool is positioned within the structure.

8. A method of releasably securing an item of equipment in a wellbore, the method comprising the steps of:

positioning a first tubular string within the wellbore, the first tubular string including a nipple having an internal profile;

positioning a second tubular string within the first tubular string, the second tubular string including the item of equipment and a releasable no-go tool having at least one key;

applying a first pressure to the second tubular string, thereby extending the key radially outward from the second tubular string; and engaging the key with the profile, thereby securing the item of equipment relative to the first tubular string.

9. The method according to claim 8, wherein the key is positioned below the profile in the applying step, and the key is displaced upward relative to the profile to engage the key with the profile in the engaging step.

10. The method according to claim 8, further comprising the step of applying an upwardly directed force to the second tubular string, thereby locking the key in engagement with the profile.

11. The method according to claim 10, further comprising the step of releasing the first pressure applied to the second tubular string while the upwardly directed force is applied to the second tubular string, with the key remaining locked in engagement with the profile.

12. The method according to claim 8, wherein the first pressure applying step further comprises radially outwardly displacing the key against a radially inwardly biasing force of the key.

13. The method according to claim 8, wherein the first pressure applying step further comprises displacing at least one piston, the piston forcing the key radially outward.

14. The method according to claim 13, further comprising the step of applying a second pressure to the second tubular string, thereby closing a first valve and preventing fluid communication between the piston and the interior of the second tubular string.

15. The method according to claim 14, wherein the second pressure applying step further comprises opening a second valve, thereby permitting fluid communication between the piston and the exterior of the second tubular string.

16. The method according to claim 8, further comprising the step of applying a predetermined force to the second tubular string after the engaging step, thereby releasing the key for axial displacement relative to the housing.

17. The method according to claim 8, wherein the first pressure applying step further comprises displacing at least one piston of the tool to radially outwardly bias the key, and further comprising the step of applying a predetermined force to the second tubular string after the engaging step, thereby opening a valve of the tool and permitting fluid communication between the exterior of the second tubular string and the piston.

18. A downhole equipment positioning system for a well having a casing string cemented therein, the system comprising:

a nipple interconnected in the casing string, the nipple having an internal profile; and a tubing string reciprocably received within the casing string, the tubing string including a tool interconnected therein, the tool including at least one key, and the key being radially outwardly displaced for engagement with the profile when a first pressure is applied to the tubing string, the key and the profile having complementarily shaped back angles formed thereon, the back angles cooperating to prevent radially inward displacement of the key out of engagement with the profile when the first pressure is released from the tubing string.

19. A downhole equipment positioning system for a well having a casing string cemented therein, the system comprising:

a nipple interconnected in the casing string, the nipple having an internal profile; and a tubing string reciprocably received within the casing string, the tubing string including a tool interconnected therein, the tool including at least one key, and the key being radially outwardly displaced for engagement with the profile when a first pressure is applied to the tubing string, the key being circumferentially continuous and circumscribing a housing of the tool, the tool including multiple pistons circumferentially distributed with respect to the key, at least one piston radially outwardly biasing the key when the first pressure is applied to the tubing string.

20. A downhole equipment positioning system for a well having a casing string cemented therein, the system comprising:

a nipple interconnected in the casing string, the nipple having an internal profile; and a tubing string reciprocably received within the casing string, the tubing string including a tool interconnected therein, the tool including at least one key, and the key being radially outwardly displaced for engagement with the profile when a first pressure is applied to the tubing string;

the tool including at least one piston radially outwardly biasing the key when the first pressure is applied to the tubing string, a first valve selectively permitting and preventing fluid communication between the piston and an internal flow passage extending through the tool, the first valve being closed, preventing fluid communication between the piston and the flow passage, when a second pressure is applied to the tubing string, and a second valve, the second valve selectively permitting and preventing fluid communication between the piston and the exterior of the tool.

21. The system according to claim 20, wherein the second valve is opened, permitting fluid communication between the piston and the exterior of the tool, when the second pressure is applied to the tubing string.

22. A downhole equipment positioning system for a well having a casing string cemented therein, the system comprising:

a nipple interconnected in the casing string, the nipple having an internal profile; and a tubing string reciprocably received within the casing string, the tubing string including a tool interconnected therein, the tool including at least one key, and the key being radially outwardly displaced for engagement with the profile when a first pressure is applied to the tubing string; and the tool further including a piston outwardly biasing the key when the first pressure is applied to the tubing string and a valve, the valve being opened to permit fluid communication between the piston and the exterior of the tool when a predetermined force is applied to the tubing string while the key is engaged with the profile.

* * * * *